United States Patent [19]

Yates et al.

[11] Patent Number: 4,947,705

[45] Date of Patent: Aug. 14, 1990

[54] METHOD AND APPARATUS FOR MAINTAINING A LOAD RAISING LINKAGE IN A RASIED POSITION

[75] Inventors: Steve K. Yates, Scotland, Pa.; Tracy M. Darland, Cheshire, England

[73] Assignee: Ingersoll-Rand Company, Woodcliff Lake, N.J.

[21] Appl. No.: 488,502

[22] Filed: Mar. 5, 1990

Related U.S. Application Data

[63] Continuation of Ser. No. 351,082, May 12, 1989, abandoned.

[51] Int. Cl.[5] ..... B66C 23/88

[52] U.S. Cl. ..... 74/529; 74/527; 92/25; 414/685; 414/722

[58] Field of Search ..... 74/527, 529, 532; 414/685, 722; 92/15, 21 MR, 25

[56] References Cited

U.S. PATENT DOCUMENTS

| | | | |
|---|---|---|---|
| 3,135,555 | 5/1963 | Me Caskey | 298/22 R |
| 3,360,146 | 6/1929 | Borer et al. | 414/713 |
| 3,662,653 | 5/1972 | Carlson et al. | 74/527 |
| 3,918,601 | 11/1975 | Zimmerman | 414/713 |
| 3,982,648 | 9/1976 | Luedtke et al. | 414/713 |
| 3,995,761 | 12/1976 | Hurlburt | 414/713 |
| 4,039,093 | 8/1977 | Schmitz et al. | 414/680 |
| 4,278,394 | 7/1981 | Johnson | 414/694 |
| 4,352,626 | 10/1982 | Frisbe et al. | 414/722 |
| 4,522,554 | 6/1985 | Williams et al. | 414/686 |

FOREIGN PATENT DOCUMENTS 1531063 8/1969 Fed. Rep. of Germany .

*Primary Examiner*—Leslie A. Braun
*Assistant Examiner*—Scott Anchell
*Attorney, Agent, or Firm*—James R. Bell

[57] ABSTRACT

A device for maintianing a load raising linkage in a raised position. A power member is provided for raising and lowering the linkage. A locking member is pivotally connected to the load raising linkage. The locking member is movable between a lock position and an unlock position. An anchor is connected to the linkage. A releasable member is carried by the locking member. The releasable member engages the anchor and maintains the locking member in the unlock position. Upon pivoting the locking member to the lock position, the releasable member can also engage the power member and maintain the locking member in the lock position.

3 Claims, 5 Drawing Sheets

METHOD AND APPARATUS FOR MAINTAINING A LOAD RAISING LINKAGE IN A RASIED POSITION

This application is a file wrapper continuation of application Ser. No. 351,082, filed May 12, 1989, now abandoned.

BACKGROUND OF THE INVENTION

This invention relates generally to excavating and more particularly to machinery which raises loads by mechanical and hydraulic means.

Front-end loaders and other machines which raise loads by mechanical and hydraulic means, require a positive means for locking the linkage in a raised position. This permits repairs or maintenance to be performed on the loading linkage components, or on some other area of the machine which is not accessible when the linkage is in a lowered position.

Such locking means would preferably be attached to the machine so as to be readily available to an operator or a mechanic when needed, and readily movable between locking and unlocking positions.

The foregoing illustrates the need for and the advantages of providing such a locking means. Accordingly, such a locking means is provided and includes features more fully described hereinafter.

SUMMARY OF THE INVENTION

In one aspect of the invention, this is accomplished by providing apparatus for maintaining a load raising linkage in a raised position. A power means is provided for raising and lowering the linkage. A locking member is pivotally connected to the load raising linkage. The locking member is movable between a lock position and an unlock position. An anchor is connected to the linkage. A releasable means is carried by the locking member. The releasable means engages the anchor and maintains the locking member in the unlock position. The releasable means also engages the power means and maintains the locking member in the lock position.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF THE DRAWING FIGURES

Figure 1:
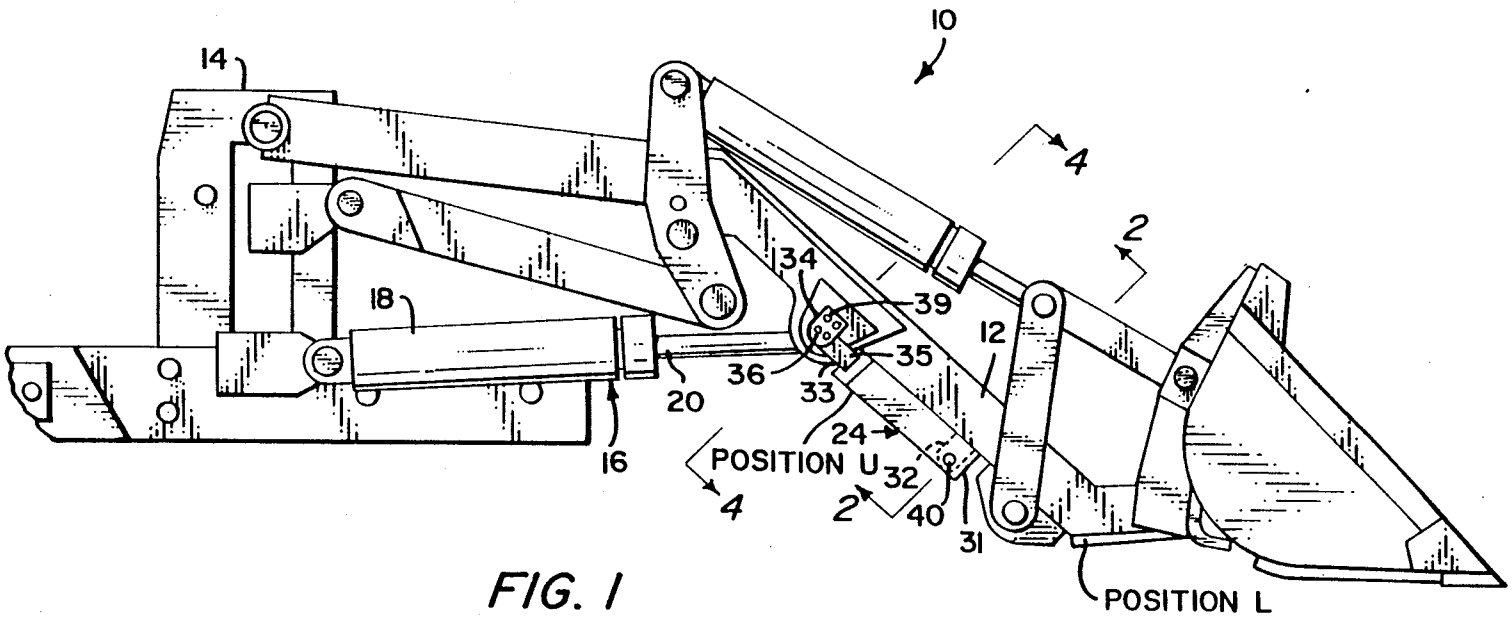
FIG. 1 is a side view of an embodiment of a load raising linkage in a lowered position.
Figure 3:
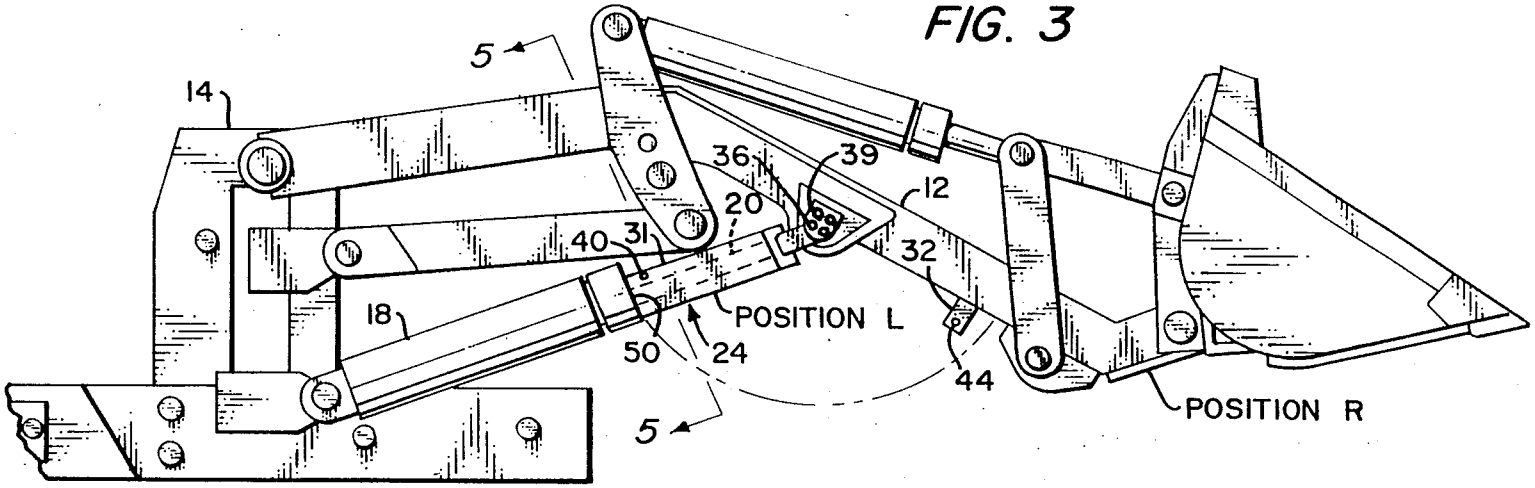
FIG. 3 is a side view illustrating an embodiment of the load raising linkage in a raised position.
Figure 4:
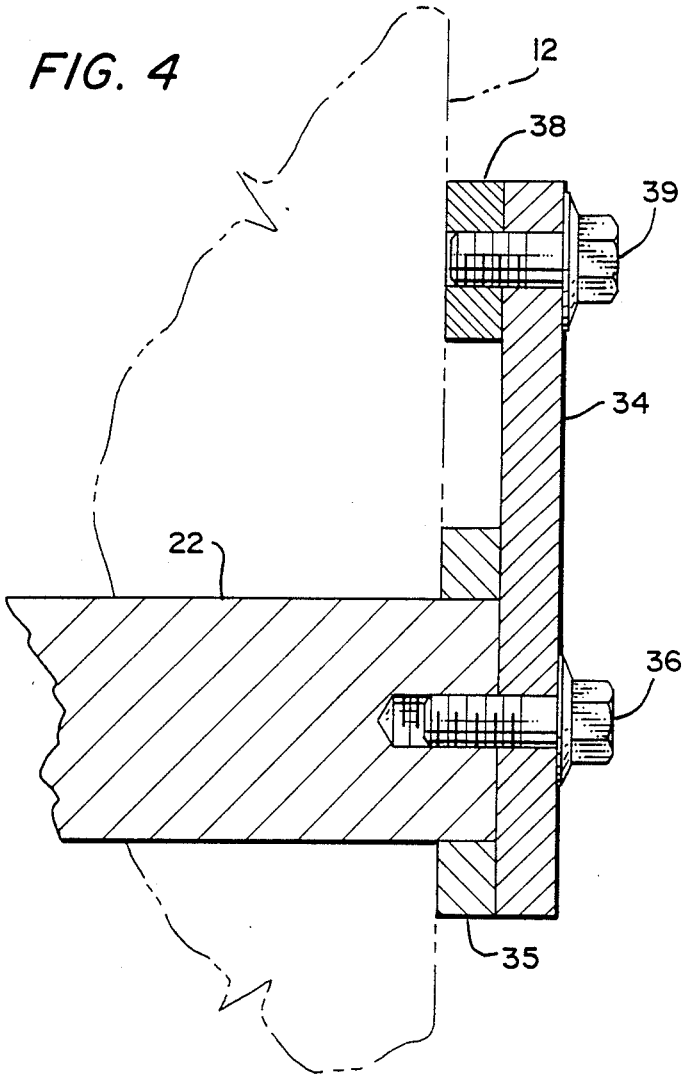
Figure 5:
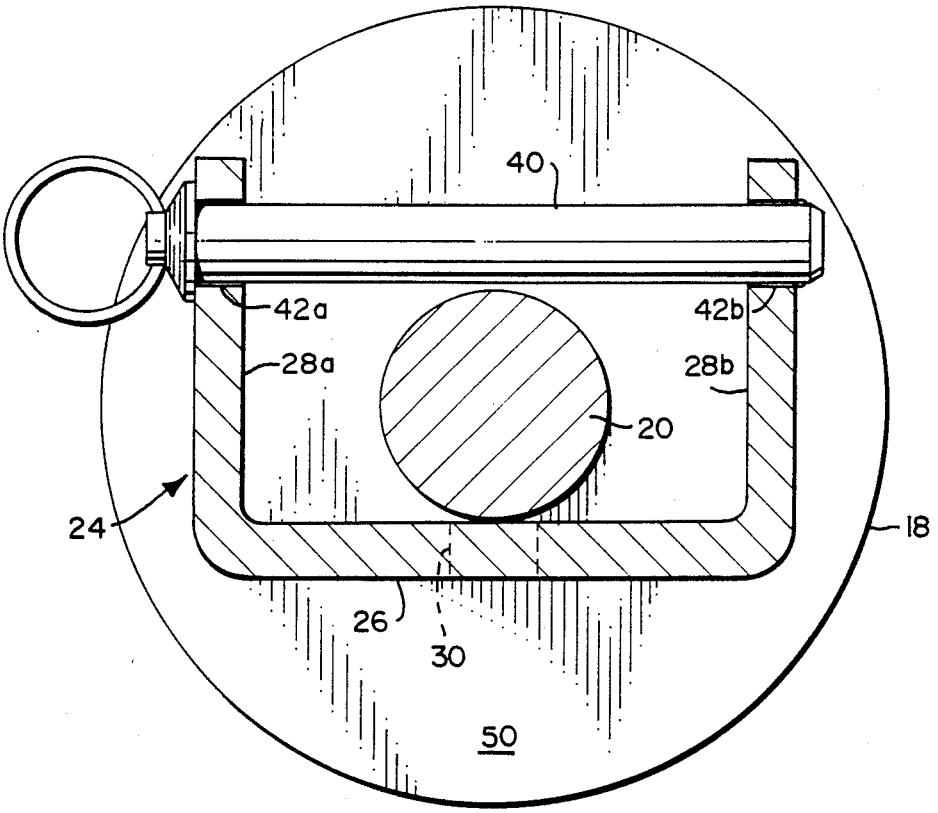

FIG. 4 a cross-sectional view illustrating an embodiment of the present invention taken along the line 4—4 of FIG. 1; and FIG. 5 is a cross-sectional view illustrating an embodiment of the present invention taken along the line 5—5 of FIG. 3.

DETAILED DESCRIPTION

In FIG. 1, a load raising linkage is generally designated 10 and includes a linkage member 12 connected to a frame 14 for movement by a power means 16 including a cylinder 18 and a piston 20 extendable and retractable therewith for moving linkage member 12 between a first lowered position designated L in FIG. 1, and a second raised position designated R in FIG. 3.

For purposes of this description, it is understood that linkage member 12 and power means 16 each represent one of a pair of parallel acting linkage members and power means well known in such load raising devices. It is also understood that as piston 20 extends from cylinder 18, linkage member 10 is moved to the position R in FIG. 3, and, as piston 20 retracts into cylinder 18, linkage member 12 is moved to the position L in FIG. 1. To accomplish this, an end of piston 20, distal from cylinder 18, is rotatably connected to and acts through a pin member 22, see FIG. 4, for moving linkage member 12 between positions L and R.

Figure 2:
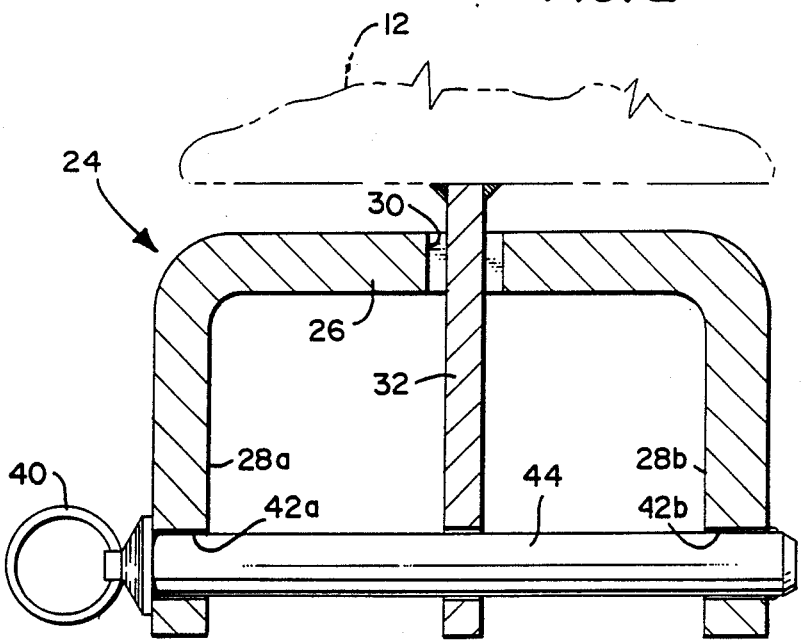
FIG. 2 is a cross-sectional view illustrating an embodiment of the present invention taken along the line 2—2 of FIG. 1.

A locking member 24, FIGS. 1 and 2, is pivotally connected to linkage member 12. Locking member 24 is preferably a fabricated steel member and is generally U-shaped having a bottom portion 26 and opposed sidewall portions **28*a*, 28*b*. A slot 30 is formed in bottom portion 26 and is positioned adjacent a first end 31 to receive an anchor member 32 fixedly attached to linkage member 12 so as to extend between sidewall portions 28*a*, 28*b* when locking member 24 is in an unlock position designated U in FIG. 1. A second end 33 of locking member 24 is pivotally connected to linkage member 12, see FIG. 4, by means of a mounting plate 35 fixedly secured to locking member 24. Plate 35 is retained by a clamping plate 34 which is secured by bolts 36 to pin member 22, and by bolts 39 to a spacer member 38 attached to linkage member 12, thus permitting pivotal movement of mounting plate 35 about pin member 22**.

A detent pin 40, FIG. 2, extends through aligned apertures **42*a*, 42*b* formed through opposed sidewall portions 28*a*, 28*b*, respectively, and through aligned aperture 44 formed through anchor member 32 for maintaining locking member 24 in position U. When linkage member 12 is raised so that piston 20 extends a suitable distance out of cylinder 18, detent pin 40 can be manually removed from aligned apertures 42*a*, 42*b* and 44, and locking member 24 can be pivoted from position U to a lock position designated L in FIG. 3, wherein piston 20 extends along locking member 24 adjacent bottom portion 26 and between opposed sidewall portions 28*a*, 28*b*. Detent pin 40, FIG. 5, can then be manually reinserted through aligned apertures 42*a*, 42*b* thus engaging piston 20 and maintaining locking member 24** in position L.

Partially lowering linkage member 12 permits first end 31 of locking member 24 to engage an end 50 of cylinder 18. Thus, locking member 24 is compressed between cylinder 18 and linkage member 12 which limits further retraction of piston 20 into cylinder 18, thus limiting a further lowering of linkage member 12. In this manner, linkage 12 is maintained in position R. Due to simultaneous engagement of opposed sidewall portions **28*a*, 28*b* and bottom portion 26 of end 31 with substantially planar end 50 of cylinder 18, compression forces act substantially through the neutral axis of locking member 24 thus limiting any side loads which would induce a bending movement into member 24**.

While this invention has been illustrated and described in accordance with a preferred embodiment, it is recognized that variations and changes may be made therein without departing from the invention as set forth in the claims.

What is claimed:

1. Apparatus for maintaining a load raising linkage in a raised position, comprising:

power means for raising and lowering the linkage;

a U-shaped locking member pivotally connected to the load raising linkage, said locking member being movable between a lock position and an unlock position, said locking member having a bottom portion with a slot formed therein and two opened sidewall portions having aligned apertures formed therein;

an anchor fixedly attached to the linkage, said slot of said locking member being capable of receiving said anchor, said anchor having an aperture formed therein, said anchor apertures and said sidewall apertures being aligned in response to said slot receiving said anchor in the unlock position; and means comprising a locking pin releasably carried by the locking member for engaging the anchor aperture and the sidewall apertures for maintaining the locking member in the unlock position and for engaging the sidewall apertures and the power means for maintaining the locking member in the lock position.

2. The apparatus as defined in claim 1, wherein the power means includes a cylinder and a piston extendable therefrom.

3. A load raising linkage of the type having a power means including a cylinder and a piston extendable from the cylinder for moving the linkage between a lowered position and a raised position, wherein the improvement comprises:

a locking member pivotally connected to the load raising linkage, said locking member being movable between a lock position and an unlock position, said locking member including a bottom portion having a slot formed therein and two opened sidewall portions having aligned apertures formed therein;

an unlock position anchor having an aperture formed therein, said anchor connected to the linkage, said slot of said locking member being capable of receiving said anchor;

means carried by the locking member and removable therefrom for engaging the sidewall apertures and the anchor aperture said anchor aperture being aligned with the sidewall apertures in response to said slot receiving said anchor in the unlock position for maintaining the locking member in the unlock position, and for engaging the sidewall apertures and the piston for maintaining the locking member in the lock position, whereby the linkage is partially lowered to a position wherein the locking member is compressed between the linkage and the cylinder.

* * * * *

UNITED STATES PATENT AND TRADEMARK OFFICE

CERTIFICATE OF CORRECTION

PATENT NO. : 4,947,705

DATED : 08/14/90

INVENTOR(S) : Steve K. Yates, Tracy M. Darland

It is certified that error appears in the above—identified patent and that said Letters Patent is hereby corrected as shown below:

Title: delete "RASIED" and insert--RAISED--.

Abstract: line 1, delete "maintianing" and insert--maintaining--.

Column 2, line 68, delete "movement" and insert--moment--.

Column 4, line 19, after "anchor;" insert--and--.

Signed and Sealed this

Twenty-fourth Day of September, 1991

*Attest:*

HARRY F. MANBECK, JR.

*Attesting Officer*

*Commissioner of Patents and Trademarks*